United States Patent [19]

Carbonaro

[11] 4,275,794

[45] Jun. 30, 1981

[54] TOOL EQUIPPED WITH A PERCUSSIVE DEVICE

[75] Inventor: Mario Carbonaro, Brussels, Belgium

[73] Assignee: Compagnie Francaise des Petroles, Paris, France

[21] Appl. No.: 929,581

[22] Filed: Jul. 31, 1978

[30] Foreign Application Priority Data

Aug. 5, 1977 [FR] France ..... 77 24268

[51] Int. Cl.[3] ..... E21B 4/14

[52] U.S. Cl. ..... 173/135; 173/73

[58] Field of Search ..... 91/50, 51; 173/73, 135, 173/136

[56] References Cited

U.S. PATENT DOCUMENTS

| | | | |
|---|---|---|---|
| 1,353,796 | 9/1920 | Stage | 173/135 X |
| 2,422,031 | 6/1947 | Merten | 91/50 |
| 2,800,884 | 7/1957 | Mori | 173/73 |
| 3,602,317 | 8/1971 | Scroggins | 173/73 |
| 4,069,876 | 1/1978 | Pototsky et al. | 173/73 X |
| 4,133,398 | 1/1979 | Richards | 173/73 X |

*Primary Examiner*—Wm. Carter Reynolds

*Attorney, Agent, or Firm*—Sughrue, Rothwell, Mion, Zinn and Macpeak

[57] ABSTRACT

The invention relates to a tool which incorporates a device insuring the efficient control of a percussive hammer, regardless of the drilling depth. For this purpose, drive sludge arriving in an annular space reaches an inlet of a fluid switching element of single or double stability in which the flow of fluid alternates between two fluid circuits, causing the hammer to strike and return.

13 Claims, 3 Drawing Figures

TOOL EQUIPPED WITH A PERCUSSIVE DEVICE

The invention relates to a tool which is equipped with a percussive device and more particularly to a drilling tool having a percussive device for the purpose of improving the speed of penetration into rock.

It has been known for a long time to produce drilling tools possessing a rotary and a percussive action, these tools being driven by conventional means, the drive element being a pressurised fluid, the feed of which is controlled by slide-valves ensuring the repeated opening and shutting of passages for the fluid which controls, in particular, the alternating motion of a piston. When the tool and the drill-hole are of small dimensions, tools of this kind are efficient and their production does not present any difficulty.

However, even at a shallow depth, driving a drilling tool by means of drilling sludge and using known techniques presents great difficulties, especially because of the pressures encountered and the need to ensure that the slide-valves or other drive means remain leaktight despite the rapid frequency of the motions.

In order to avoid difficulties of this kind, it has been recommended to replace the percussion by the transmission of vibrations to the drilling tool, thus removing the difficulties inherent in the customary techniques. However, the action of the tool on the rock is only performed in accordance with a very special method which does not achieve output largely dependent on the gap between the points at which an element of the tool strikes the rock.

By way of example of a tool operating by rotation and vibration, there may be mentioned a tool in which drilling sludge is periodically directed, by means of a fluid oscillator, into a chamber separating two masses which are joined at their periphery by an elastic cylinder. The oscillator causes these masses to resonate and this imparts to the tool, which is integral with one of these masses, vibrations assisting the advance.

According to the present invention there is provided a tool equipped with a percussive device and provided with a fluid drive element operable to change the flowpath of the fluid, flow of fluid along the flowpath being operable to drive the percussive device in one direction and flow along another path being operable to drive the percussive device in the opposite direction, the percussive device in moving in one direction engaging a stop-piece for transmitting the blow to a tool element.

The fluid is fed to the drive element from a nozzle having an outlet orifice of annular transverse cross-section, and the fluid element has at least one first conical surface along which stabilised flow can be established for flow in one direction and a second surface for establishing flow in the other direction. Change of direction may be effected by return of fluid.

The fluid in the case of drilling is a drilling sludge which provides the precise control of the percussion whilst performing its normal function of lubrication and return of debris.

The second surface of the fluid drive element may also be a conical surface along which stable flow can be established.

It is possible to operate both at very low frequencies and at very high frequencies.

In order that the invention may be well understood there will now be described an embodiment thereof, given by way of example only, reference being made to the drawing in which.

Figure 1:
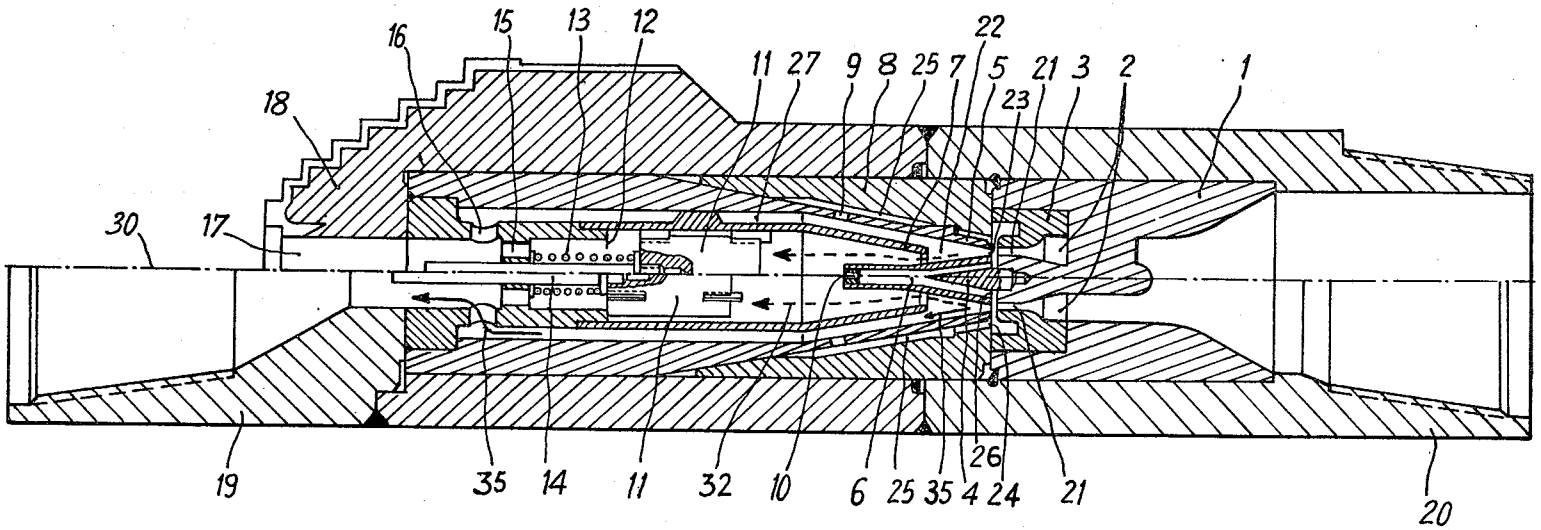
FIG. 1 is an axial section of an embodiment of tool.

To illustrate that various tool elements may be fitted to a tool according to the invention, the illustrated embodiment shows a drilling tool element 18 above a tool axis 30 and a simple fixing cone 19 has been shown below this axis, either of these being fast with an annular body 20. The elements 18, 19 are merely illustrative of various tools to which the percussive device may be attached. Drilling sludge is fed to the body 20 and thus to an inlet of a piece 1 which has an outlet nozzle 3 which distributes sludge fed by piece 1 to an annular neck 2 of the nozzle. The outlet of the nozzle is in the form of a cylindrical shell 21 terminating upstream of an annular opening 23 delimited by the ends of a conical part of an internal piece 10 and a conical part of an external piece 5 which surrounds the piece 10. The annular opening 23 is located at a sufficient distance from the outlet of the cylindrical shell 21 to permit flow in this space to connect, on the one hand, with an internal opening 26 communicating with a channel 6, it being possible for this opening to be annular or circular depending on whether an internal part 4 is present or absent, and, on the other hand, with an external annular opening 24 adjacent the ends of conical pieces 8 and 5. A space 25 between the conical pieces 8 and 5 connects at openings 9 in the piece 5 with a space 27 between the piece 5, which guides 'external' flow and a piece 7 which separates 'internal' and 'external' flows.

A conical part of the piece 7 receives a part of the piece 10, the conical part of the latter acting as a guide for the 'internal' flow, whilst a cylindrical part of piece 7 serves as a guide for a percussive hammer 11. The latter is shown, above the axis 30, in a position away from the stopping surface of a piece 12, to which position it is biased by a spring 13 bearing on a part of the piece 12 adjacent passages 15 in that piece, and on a member 28 on a rod 14 which penetrates the base of the hammer 11 and is slidable in piece 12. Below the axis 30, the hammer 11 is shown at the end of a percussion stroke in contact with the stop-piece 12. The rod may serve to limit the hammer movement away from the stop-piece.

For the discharge of sludge, space 27 is connected with a channel 17 by means of openings 16 in the piece 12.

The configuration of the outlet side of nozzle 3 and the end regions of the conical parts of pieces 8, 5, 7 and 10 forms a fluid element structure producing a Coanda effect, that is to say producing a flow which will adhere in a stable manner to one or other of two conical surfaces, the external surface of the conical part of internal piece 10 and the internal surface of the conical part of external piece 5 being the two surfaces.

By this arrangement a thrust can be developed onto one or the other of the opposite end surfaces of the hammer 11, when the fluid element formed in this way is switched so as to direct the flow onto the desired face of the hammer.

In the example shown, this fluid element structure operates as a double-stability element. In fact, consider the case where the hammer 11 is in a position away from the stop-piece 12, the spring 13 being extended. The sludge issuing from the annular nozzle 21 and flowing through the passage 27 tends, in addition to flowing through the channel 17 and the passage 15, to come up through the orifices 9 towards the external opening 24, as shown by the arrows 31, with the result that the primary flow, which is stable along the internal part of the cone 5, passes abruptly into the chamber 22 in the direction 32 along the conical partition 10. The result of this action is to displace the hammer 11 which compresses the return spring 13, whilst the absence of circulation of the sludge in the direction 31 suppresses the direct action of the flow issuing from 21. However, because of the Coanda effect, this suppression has no consequence on the stability of the flow 32 along the external conical surface of the partition 10 for guiding the internal flow. As a result, the thrust exerted on the hammer 11 continues until the latter strikes the stopping surface of the piece 12. The flow 32 is thus abruptly stopped, with the result that the channel 6 of the piece 10 is subjected to a sudden reaction pressure in the direction 33 and this reaction passing through opening 26 urges the feed flow issuing from shell 21 outwardly, thus causing the flow to proceed in the direction 35 along the internal surface of the conical part of piece 5 for guiding the external flow. By passing into the space 27 and the passages 16 and 15, the fluid then acts on the striking face of the hammer 11, as indicated by the arrow 34. The hammer 11 then moves away from the piece 12 under this action, combined with the thrust of the spring 13, whilst the sludge issuing from the annular nozzle 21 and flowing through the passage 27 tends, in addition to flowing through the channel 17, to come up through the orifices 9 towards the external opening 24, as shown by the arrows 31, with the result that the flow which was stable along the cone 5 passes abruptly into the chamber 22, in the direction 32, along the conical part 10. This has the effect of pushing back the hammer 11 and the cycle resumes.

By making the double-stability element dependent on the hammer 11, a stable percussive action is produced which can easily be adapted to the kind of tool used and to the rotation speed of such a tool. It is thus possible to increase the output by adapting the blow rate to the distance between two adjacent attack elements of the tool and to the rotation speed, these three elements defining the pitch of the percussive attack. Since the blow rate is a linear function of the feed rate of the fluid element, it is seen that the combination produced makes it possible to determine very easily the best output per unit depth of cut. Moreover the difficulties encountered in ensuring the leaktightness of the slide-valves controlling the flows in the former systems are overcome since the hammer need not be a fluid tight fit in the chamber and nonetheless pressure is applied over the full face of the hammer.

Since it suffices to subject the fluid switching element, fed at 21, to the percussive action of the hammer 11 onto the body of the tool, or onto the stop fast with the latter, in order to obtain all or part of the desired effect, it is self-evident that the device described by way of an example can adopt different forms.

In particular, if the hammer 11 is of relatively low density, the spring 13 can be omitted, the hammer returning, on the one hand, under the action of the flow produced in the direction of the arrow 34, and, on the other hand, under the action of the thrust exerted by the sludge which completely bathes the hammer.

Instead of using a double-stability switching element, it is possible to provide a single-stability element, the internal flow 32 being stable and the external flow 35 being rendered unstable by, for example, modification of the conical wall 5. The internal flow 32 carries the hammer 11 towards its stop 12 which it strikes, thus abruptly stopping the flow 32. A rapid increase in pressure and a compression wave result therefrom and rise towards the nozzle 3 and, as above, move the flow away from the external wall of the piece 10 in order to proceed in the direction 35. This enables the feed-head to rise again under the combined actions of the spring 13 and the fluid 34. Since the external flow 35 is unstable, the fluid adheres to the surface 10 after the pressure has ceased to increase, and the cycle resumes. The passage 25 can therefore be omitted.

Furthermore, independently of the point discussed in the preceding paragraph, the lines 6 can be shut, it being possible for the abrupt shutting of the path 32 at piece 12, together with the rapid increase in pressure and the compression wave which result therefrom, to be sufficient to move the flow away from the external wall of the piece 10. The effect, described above, of the return of pressure at 26 through the line 6, assists uniform operation but is not therefore indispensable.

Figure 2:
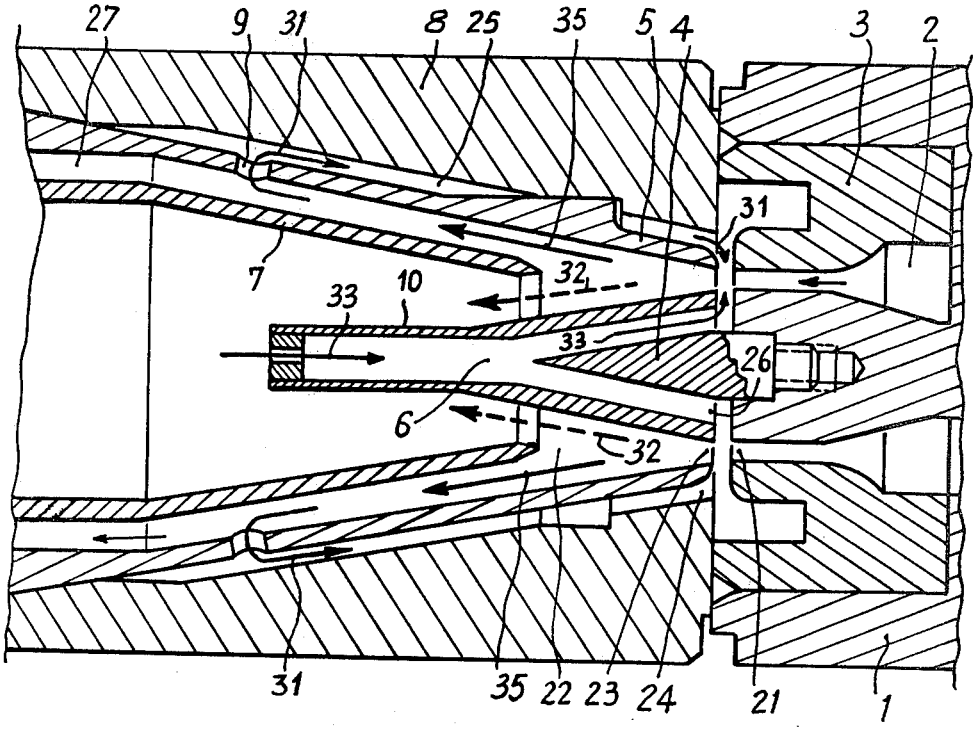
FIG. 2 is an enlargement of the upper part of the tool.
Figure 3:
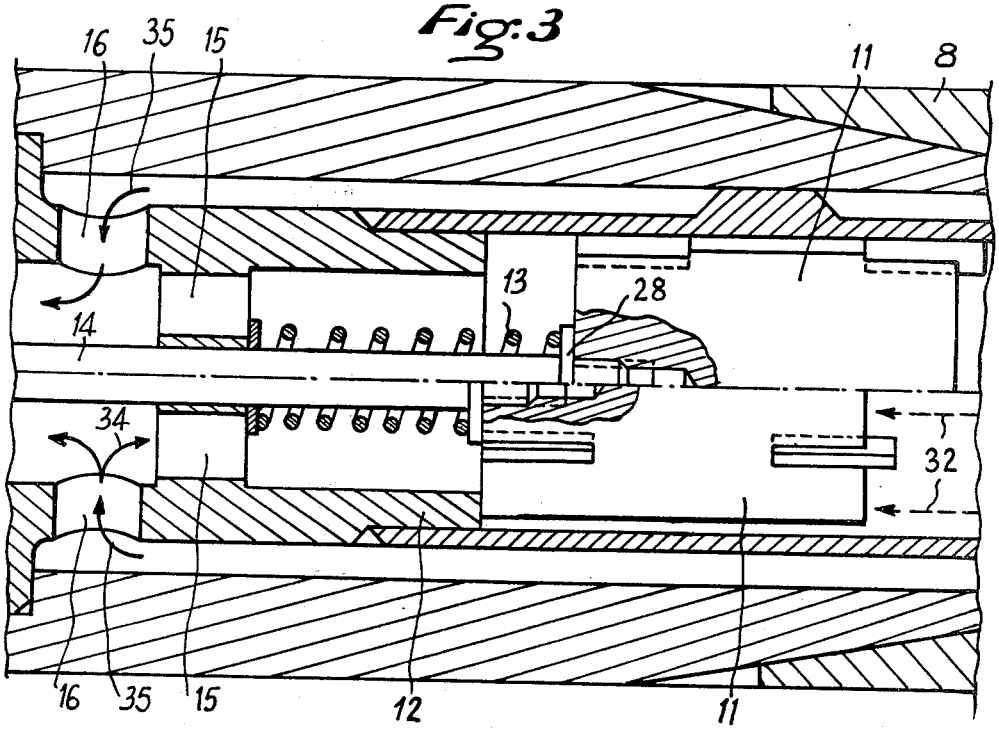
FIG. 3 is an enlargement of the lower part.

Furthermore, modifying the diagram of FIGS. 1, 2 and 3, it is also possible to bring the point of blow of the percussive hammer closer to the points of attack of the tool on the rock by the use of a stop-piece receiving the rod 14, this stop-piece being fast with the base of the tool 18 or with the fixing cone 19. Although, in this case, the shutting of the flowpath 32 may be incomplete and the hammer 11 does not come to rest on the piece 12, the correct operation of the tool is still ensured, since the fluctuation in the flow issuing from the annular nozzle 21, from the flowpath 32 to the flowpath 35, is always brought about by the abrupt increase in pressure caused by the shutting, even if this is incomplete, of the flowpath 32 and by the increase in pressure-loss which arises therefrom.

According to another variant, a second hammer can be provided at the bottom of the rod 14 of the device which is described above and comprises a stop receiving the rod 14 and not the hammer 11, which second hammer is made fast with the rod 14 and placed below the guide-piece formed by the extension of the piece 12 in which the orifices 15 are made. This second hammer increases the total mass of the percussive body and therefore the energy of each blow, the latter taking place between the second hammer and the stop-piece which is integral with the base of the tool 18 or with the fixing cone 19.

The device described above can further comprise two hammers rigidly joined together by the rod 14, the spring no longer being mounted as indicated in FIGS. 1 and 3 but being placed between any part of the fixed body of the tool and any part of the percussive body and, in particular, below the lower hammer.

It will thus be understood that numerous modifications of detail can be made to the embodiment described by way of an example, it also being possible for the sludge to be discharged through paths other than 17, depending on the tool used.

I claim:

1. A fluid operated percussive tool, comprising:

a first fluid flow path, a second fluid flow path, a fluid drive element operable to switch the flow path of the fluid, a reciprocating hammer operable to be driven in one direction in response to fluid flow along said first flow path, and in a second direction in response to fluid flow along said second flow path, and, a stop member for receiving a blow from said hammer moving in said one direction, and for transmitting said blow to a tool element, wherein said fluid drive element comprises at least a generally conical internal surface of a first external piece and a generally conical external surface of an internal piece, said fluid element being operable to stabilize fluid flow along at least one of said surfaces, and wherein a flow separator is positioned between said surfaces and includes an inner wall which comprises a chamber for said hammer.

2. A percussive tool as claimed in claim 1, wherein a reaction pressure resulting from the stopping of the motion of said hammer is operable to control the fluid element.

3. A percussive tool as claimed in claim 2, wherein the switching of flow from said internal surface is effected by the return of part of that flow.

4. A percussive tool as claimed in claim 2, and further comprising a nozzle having an outlet of annular transverse cross-section located opposite an annular inlet space defined by said internal piece and said first external piece.

5. A percussive tool as claimed in claim 4, wherein an upstream end of said first external piece comprises a portion of said fluid element that is operable in said stabilization of fluid flow.

6. A percussive tool as claimed in claim 5, wherein a downstream end of said external surface of said internal piece is exposed to a chamber in which said hammer moves.

7. A percussive tool as claimed in claim 1, wherein an external wall of the flow separator forms, together with said internal surface of said first external piece, a flow space for fluid flowing into said chamber and to that surface of said hammer which faces in the direction of hammer strike.

8. A percussive tool as claimed in claim 7, in which said flow space communicates with a fluid.

9. A percussive tool as claimed in claim 7, in which said flow space communicates with a passage which in turn communicates with the space between the nozzle outlet and the annular inlet.

10. A percussive tool as claimed in claim 2, further comprising a channel within said internal piece which will, upon said hammer abutting said stop member, direct said reaction pressure to the space between a nozzle outlet and an upstream end of said first external piece and direct stable flow from said external surface of the internal piece to the internal surface of the first external piece.

11. A percussive tool as claimed in claim 1, wherein the fluid element is a double-stability element.

12. A percussive tool as claimed in claim 1, wherein said hammer is fixed to a rod which limits the distance of separation of the hammer from the stop member.

13. A percussive tool as claimed in claim 1, in which a spring acts on the hammer.

* * * * *